US006578942B1

(12) United States Patent
Tuhro et al.

(10) Patent No.: US 6,578,942 B1
(45) Date of Patent: Jun. 17, 2003

(54) LIQUID CRYSTAL SENSING OF THERMAL INK JET HEAD TEMPERATURE

(75) Inventors: Richard H. Tuhro, Webster, NY (US); Frederick A. Donahue, Walworth, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/120,303

(22) Filed: Apr. 10, 2002

(51) Int. Cl.[7] ..... B41J 29/38
(52) U.S. Cl. ..... 347/14
(58) Field of Search ..... 347/14, 17, 189, 347/194; 374/131, 150, 157, 162, 141, 152

(56) References Cited

U.S. PATENT DOCUMENTS

| | | | | | |
|---|---|---|---|---|---|
| 3,871,212 | A | * | 3/1975 | Neugroschl | 73/88 A |
| 4,571,599 | A | | 2/1986 | Rezanka | 347/87 |
| RE32,572 | E | | 1/1988 | Hawkins et al. | 156/626 |
| 4,910,528 | A | | 3/1990 | Firl et al. | 347/17 |
| 5,075,690 | A | | 12/1991 | Kneezel | 347/17 |
| 5,168,284 | A | | 12/1992 | Yeung | 347/17 |
| 5,172,142 | A | | 12/1992 | Watanabe et al. | 347/14 |
| 5,220,345 | A | | 6/1993 | Hirosawa | 347/17 |
| 5,221,397 | A | | 6/1993 | Nystrom | 156/273.5 |
| 5,223,853 | A | | 6/1993 | Wysocki et al. | 347/14 |
| 5,315,316 | A | | 5/1994 | Khormaee | 347/3 |
| 5,406,315 | A | * | 4/1995 | Allen et al. | 347/7 |
| 5,745,130 | A | | 4/1998 | Becerra et al. | 347/14 |

* cited by examiner

*Primary Examiner*—Benjamin R. Fuller
*Assistant Examiner*—Alfred Dudding
(74) *Attorney, Agent, or Firm*—Perman & Green, LLP

(57) ABSTRACT

In the system of this application, a liquid crystal temperature sensor is applied to the exterior of the print head cartridge of a printing system to give an optical indication of the temperature at the print head that is readable by an optical scanner.

3 Claims, 3 Drawing Sheets

LIQUID CRYSTAL SENSING OF THERMAL INK JET HEAD TEMPERATURE

BACKGROUND OF THE SYSTEM OF THIS APPLICATION

1. Field of the Disclosure

The present invention relates to a thermal ink jet printer and, more particularly, to a system and method for sensing the operating temperature of a print head.

2. Related Prior Art

Ink jet printers eject ink onto a print medium such as paper in controlled patterns of closely spaced dots. To form color images, multiple ink jet print heads are used, with each head being supplied with ink of a different color. Thermal ink jet printing systems use thermal energy selectively produced by resistors located in ink filled channels. Firing signals are applied to the resistors through associated drive circuitry to vaporize momentarily the ink and form bubbles on demand. Each temporary bubble expels an ink droplet and propels it toward a recording medium. The printing system may be incorporated in either a carriage type printer or a page width type printer. A carriage type printer, such as the type disclosed, for example, in U.S. Pat. No. 4,571,599 and U.S. Pat. No. Reissue 32,572, generally includes a relatively small print head containing ink channels and nozzles. The contents of these patents are hereby incorporated by reference. The print head is usually attached to a sealed ink supply and the combined print head and ink supply form a cartridge assembly which is reciprocated to print one swath of information at a time on paper that is held stationary. After the swath is printed, the paper is stepped a distance equal to the height of the printed swath, so that the next printed swath will be contiguously printed. The procedure is repeated until the entire page is printed. The page width printer has a stationary print head having a length equal to or greater than the width of the paper. The paper is continually moved past the page width print head in a direction normal to the print head length at a constant speed during the printing process. An example of a page width printer is found in U.S. Pat. No. 5,221,397, whose contents are hereby incorporated by reference.

A known problem with thermal ink jet printers is the degradation in the output print quality due to increased volume of ink ejected at the print head nozzles resulting from fluctuations of print head temperatures. These temperatures produce variations in the size of the ejected drops which result in the degraded print quality. The size of ejected drops varies with print head temperature because two properties that control the size of the drops vary with print head temperature: the viscosity of the ink and the amount of ink vaporized by a firing resistor when driven with a printing pulse. Print head temperature fluctuations commonly occur during printer startup, during changes in ambient temperature, and when the printer output varies.

When printing text in black and white, the darkness of the print varies with print head temperature because the darkness depends on the size of the ejected drops. When printing gray-scale images, the contrast of the image also varies with print head temperature because the contrast depends on the size of the ejected drops. When printing color images, the printed color varies with print head temperature because the printed color depends on the size of all the primary color drops that create the printed color. If the print head temperature varies from one primary color nozzle to another, the size of drops ejected from one primary color nozzle will differ from the size of drops ejected from another primary color nozzle. The resulting printed color will differ from the intended color. When all the nozzles of the print head have the same temperature but the print head temperature increases or decreases as the page is printed, the colors at the top of the page will differ from the colors at the bottom of the page. To print text, graphics, or images of the highest quality, the print head temperature must remain constant.

Various print head temperature controlling systems and methods are known in the prior art for sensing print head temperature and using sensed temperature signals to compensate for temperature fluctuations or increases.

U.S. Pat. No. 4,910,528 discloses an analog temperature sensing system wherein a thin film temperature resistor is codeposited on a substrate with the resistors that are heated to expel ink droplets from print head nozzles. The voltage drop outputs across the temperature resistor are sent to a temperature prediction circuit that controls the print strategy to maintain the print head temperature within a predetermined operating range.

U.S. Pat. No. 5,075,690 discloses an analog temperature sensor for an ink jet print head, which achieves a more accurate response by forming the thermistor on the print head substrate, and of the same polysilicon material as the resistors that are heated to expel droplets from the print head nozzles relative to ink temperature.

U.S. Pat. No. 5,220,345 discloses a print head temperature control system that places a plurality of temperature detectors at different positions and monitors the temperature differences to control ink supplied to the associated ink channels.

U.S. Pat. No. 5,315,316 discloses a print head temperature control circuit that includes a temperature sensor formed on the print head substrate. Analog signals from the sensor are delayed and analyzed by a data processor. A temperature summing operation is performed during a print operation and the sum is compared to a previously stored value to determine whether ink flow through the print head is sufficient for continued printing.

The device described in U.S. Pat. No. 5,172,142 senses changes in a temperature sensor to change the driving frequency of the print head. Analog signals from the sensor are converted into digital signals that are sent to a sequence controller for controlling operation of a pulse motor driver.

U.S. Pat. No. 5,168,284 discloses a closed loop system, which produces non-printing, pulses in response to a difference between a reference temperature signal and print head temperature signals produced by a temperature sensor located on the print head.

U.S. Pat. No. 5,223,853 to Wysocki et al. discloses a method of controlling the spot sizes printed by a thermal ink jet printer. The temperature of the ink in the print head is sensed. A combination of power level and time duration of the electrical input signal to the heating elements is selected based on the sensed temperature. A predetermined function relates the energy of the input signal to the corresponding resulting size of the spot on the copy sheet.

According to the prior art the preferred solution is to imbed an electronic temperature sensor within the print head. Problems arise because of sensor design, the difficulties of calibration, and changes due to mounting stress, encapsulation shifts, vibration, noise and other influences. To provide absolute calibration, further solid state sensors are being considered. It is a purpose of the system of this application to provide a sensing device that can be reliably calibrated prior to installation and that is more cost effective than solid state devices. It is another object of the system of this invention to use a liquid crystal type temperature sensor to provide this function.

SUMMARY OF THE DISCLOSURE

Thermal ink jet printers are sensitive to temperature fluctuations at the print head. As a result the control circuitry is designed to respond to temperature sensed at the print head. The temperature sensors that are used are generally imbedded in the print head substrate to sense the approximate temperature of the ink. The output of such sensors is processed to provide digital signals, relative to ink temperature, to the microprocessor controller for the system.

In the system of this application, a liquid crystal temperature sensor is applied to the exterior of the print head cartridge. Liquid crystal temperature sensors give an optical indication of ambient temperature that is readable by an optical scanner. Since in many applications the print head cartridge is already optically scanned, the temperature sensor of this application may be readily integrated into existing designs. The liquid crystal temperature sensor is applied to the print head cartridge adjacent to the print head brand code to enable the optical reader to scan the temperature indication in addition to the brand code. Through appropriate circuitry the temperature signal from the sensor may be isolated and converted to digital form for use by the print controller.

In the printing operation either the print head is moved relative to the paper, or the paper is moved under the print head. In either instance there exists relative movement between the print head and adjacent structure. The optical reader is mounted to read the temperature indication during such relative motion.

BRIEF DESCRIPTION OF THE DRAWING

The system of this invention is described in more detail below with reference to the attached drawing in which.

DETAILED DESCRIPTION

As indicated in the Background above, the prior art has attempted many ways to sense the temperature of the ink in thermal ink jet printer. Most of these devices require imbedding a thermal sensor within the print head. A system of this type is described in U.S. Pat. No. 5,745,130 which issued on Apr. 28, 1998, the disclosure of which incorporated herein by reference. One thing that is clear from the Background is that printing performance in a thermal ink jet printer is dependent on accurate monitoring of the heat of the print head. The system of this invention is directed to obtaining an indication of print head temperature at a position outside of the print head.

Figure 1:
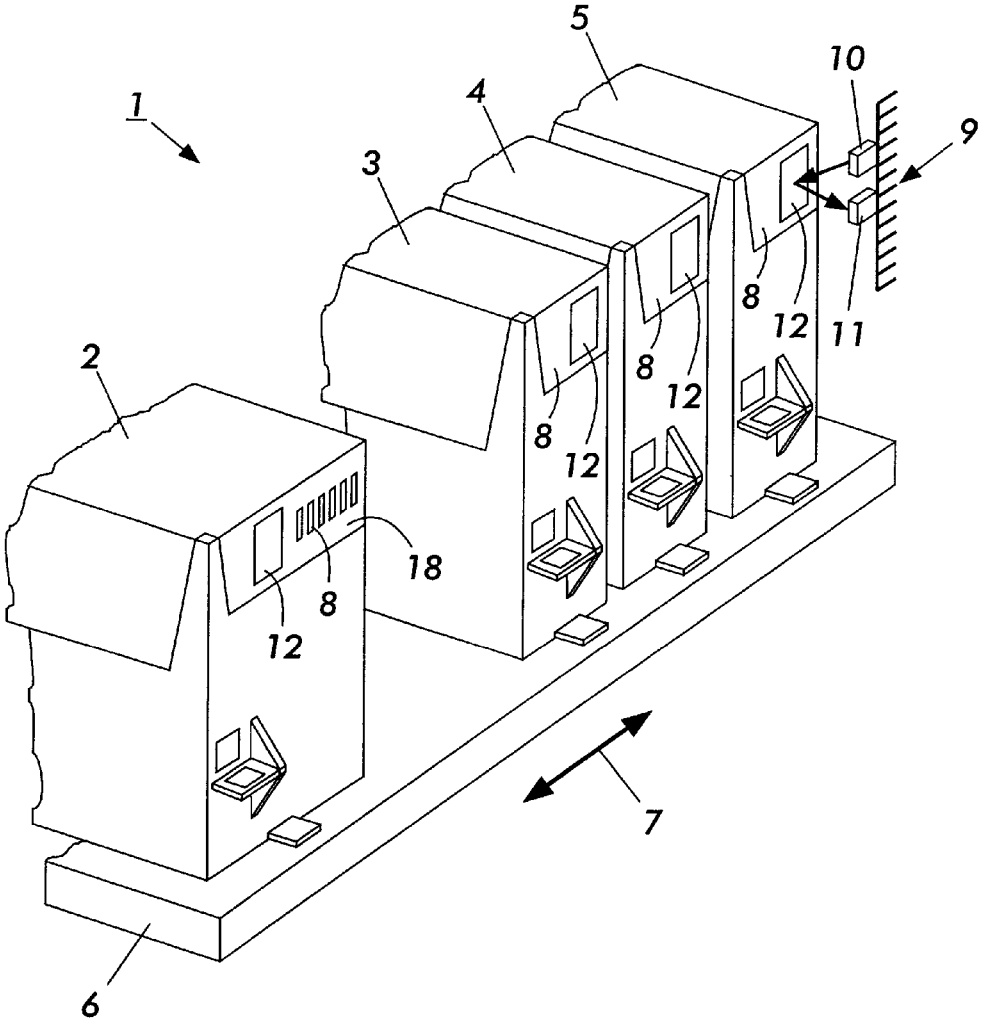
FIG. 1 is a perspective schematic view showing an assembly of print head cartridges using the system of this application.

As shown schematically in FIG. 1(*a*), a print head 1 consists of an assembly of print cartridges 2–5 in which cartridge 2 contains black ink and the remaining cartridges 3–5 contain the colors. In the illustrated printer, the print head 1 is mounted on a moveable carriage 6 for reciprocating motion generally in the direction of arrow 7. Each cartridge is provided with a reflector tag 8 for presenting coded information 18 relating to the manufacturer of the cartridge. The coded information 18 is read by optical scanner 9 which consists of a light source 10, such as a light emitting diode or laser, and a light pickup 11, such as a light sensitive diode. Light from source 10 reflected off of the reflector tag 8 is sensed by pickup 11.

According to the system of this application, a liquid crystal temperature indicator 12 is added to the reflector tag 8 in a position that allows indicator 12 to be sequentially read by optical scanner 9. Liquid crystal thermal indicator/sensors suitable for use in this application are commercially available from Hublitz & Hublitz GmbH of Zurich, Switzerland and also from Telatemp, Inc. of Fullerton, Calif. Such sensors comprise liquid crystals that have a twisted crystalline structure. This structure expands and contracts in response to changes in temperature. Light reflected from the crystalline structure of these indicators changes in color with the temperature. According to Telatemp, a crystalline slurry is screened onto a black backing to enhance the definition of the color. These indicators can be purchased as adhesively backed strips with a rated temperature range and an accuracy of ±2° F. Outside of the range the indicator is black. The adhesive backing allows the indicators to be readily applied to reflector tag 8. Such indicators provide a high volume source of devices that are reliably calibrated.

The light source 10 can radiate either a visible or infrared light using the appropriate sensor. The light sensed by the pickup sensor is converted to a signal that is proportional to the energy reflected from the tag 8 or liquid crystal temperature indicator 12. This signal is then processed to determine the length or position of the liquid crystal temperature indicator 12. The indicator 12 is tracked as the print head moves past the sensors. The resulting signal is processed by the analog to digital converter to obtain a distinct transition point as the light transmitted to the sensor changes from low reflectance to high reflectance and visa versa.

Figure 2:
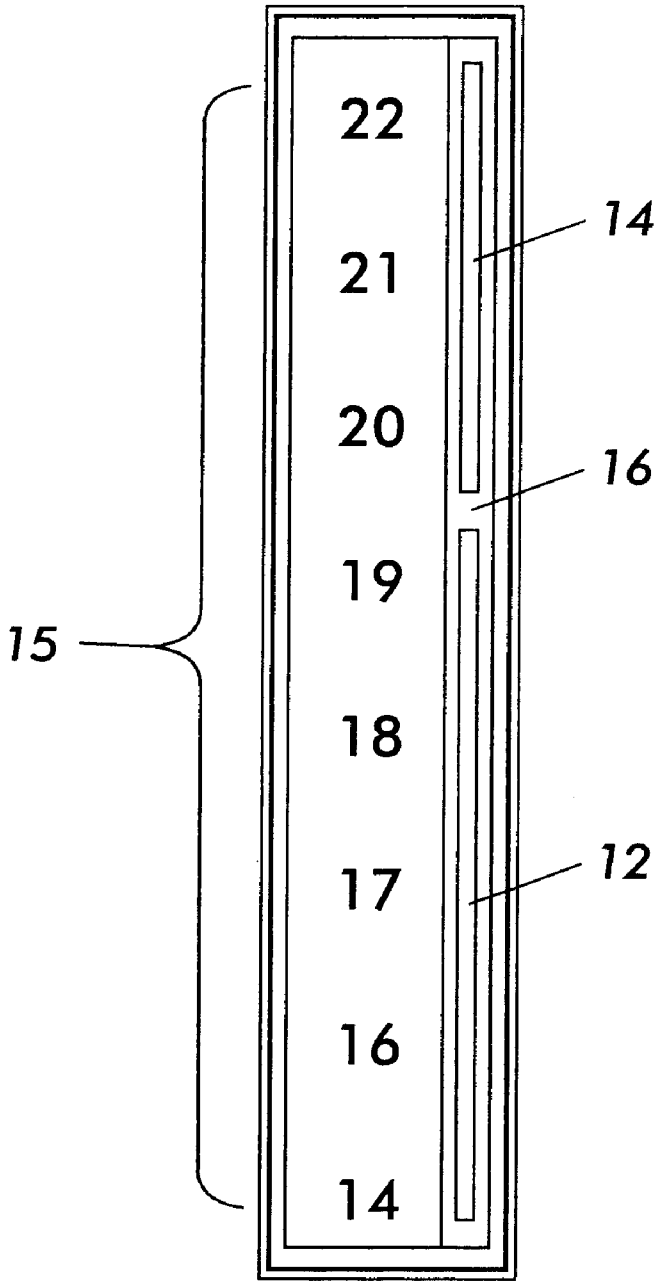
FIG. 2 is plan view of a liquid crystal thermal sensor.

As shown in FIG. 2, indicator 12 comprises an adhesively backed elongated substrate 13 having a twisted crystal structure 14 applied in the form of a strip, as shown in FIG. 2. A temperature response range 15 is shown printed on the substrate for illustration. In operation a temperature within range 15 will be indicated by the crystal changing color, for example to green, at the indicated temperature 16. By reflecting light off of the crystal structure 14, the change in light color can be sensed and converted to a signal indicative of the temperature of the print head 1. This allows the temperature to be sensed at a point closer to the print head 1 than many of the systems in which the sensor is imbedded in the control circuit board or integrated circuit for print head controller 20.

In the printing operation either the print head is moved relative to the print medium, such as paper, or the paper is moved under the print head. In either instance there exists relative movement between the print head and adjacent structure. Either way the optical scanner 9 is mounted to read the temperature indication during such relative motion.

Figure 3:
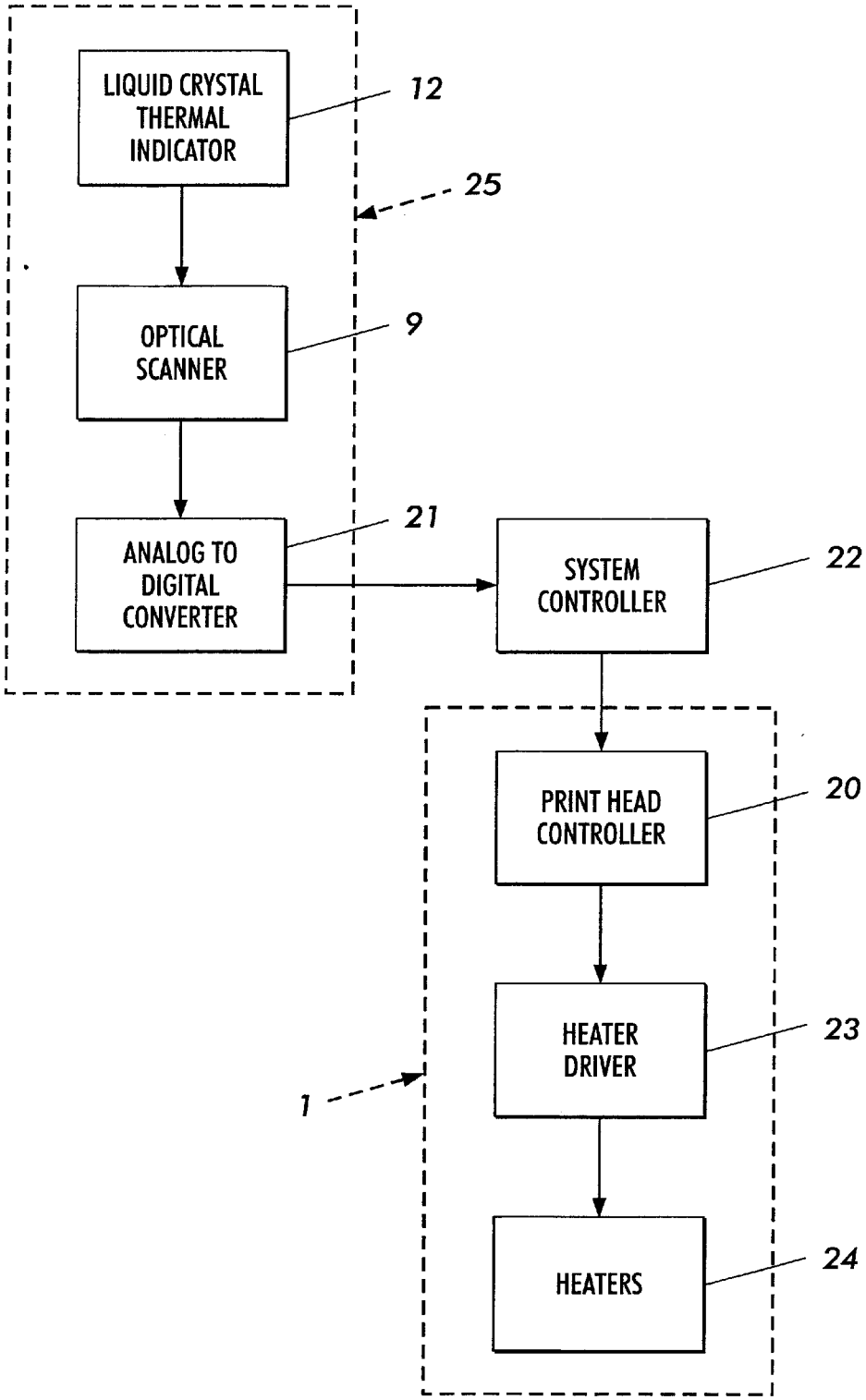
FIG. 3 is a block diagram of the control system for the print head using the system of this invention.

As shown in FIG. 3, the temperature sensing system 25 of this application includes liquid crystal thermal indicator 12, an optical scanner 9, and analog to digital processor 21. In a thermal ink jet printer application, liquid crystal temperature sensor/indicator 12 is applied to the exterior of the print head cartridges 2–5 on reflector tags 8, adjacent to the print head brand code 18 to enable the optical reader 9 to scan the temperature indication 16 in addition to the brand code 18. Through appropriate circuitry, such as analog to digital converter 21 and printer controller 22, the temperature signal from the sensor may be isolated and converted to digital form for use by the print head controller 20. The temperature signal is used to adjust the algorithm in heater driver 23 that controls the firing of heaters 24.

In this manner a cost-effective system for obtaining a temperature reading at the print head is obtained at a relatively reduced cost. The system of this application utilizes apparatus which is already in place in most printing systems and therefore is easily implemented.

Although the sensing system of this application is contemplated for use in a printing application. One skilled in the art could readily adapt the sensing system 25, to other systems where there is a need to sense the temperature of a component which moves relative to adjacent supporting structure. Any moving carriage based system, such as a document scanner or machine tool, are good examples of such systems which could benefit from the advantages of this invention. As shown in FIG. 3, system controller 22 could be a control processor for a scanner or machine tool with minor adaptation of control programs involved.

We claim:

1. A thermal ink jet printing system comprising:

a print head mounted in said printing system for depositing ink on a print medium;

a tag mounted on said print head and having a temperature indicator mounted thereon, said temperature indicator providing an optical indication of the temperature of said print head;

an optical scanner mounted in operative association with said temperature indicator to sense said optical temperature indication and generate a signal relative thereto; and a processor for receiving the signal from the optical scanner and for processing said signal for use in controlling the operation of said print head.

2. A thermal ink jet printing system, as described in claim wherein said temperature indicator comprises a liquid crystal temperature indicator.

3. A thermal ink jet printing system, as described in claim wherein said optical scanner further comprises:

a light source for directing light on said temperature indicator; and a light sensitive element for receiving light reflected from said temperature indicator.

* * * * *